US008620192B2

(12) United States Patent
Veregin et al.

(10) Patent No.: US 8,620,192 B2
(45) Date of Patent: Dec. 31, 2013

(54) DUAL TONER REPLENISHER ASSEMBLY FOR CONTINUOUSLY VARIABLE GLOSS

(75) Inventors: Richard P. N. Veregin, Mississauga (CA); Edward Graham Zwartz, Mississauga (CA); Eric Rotberg, Toronto (CA)

(73) Assignee: Xerox Corporation, Norwalk, CT (US)

( * ) Notice: Subject to any disclaimer, the term of this patent is extended or adjusted under 35 U.S.C. 154(b) by 183 days.

(21) Appl. No.: 13/290,436

(22) Filed: Nov. 7, 2011

(65) Prior Publication Data

US 2013/0114980 A1 May 9, 2013

(51) Int. Cl.
*G03G 15/08* (2006.01)

(52) U.S. Cl.
USPC ..... 399/254

(58) Field of Classification Search
USPC ..... 399/254; 430/45.53
See application file for complete search history.

(56) References Cited

U.S. PATENT DOCUMENTS

| | | | | |
|---|---|---|---|---|
| 5,234,783 | A | 8/1993 | Ng | |
| 5,480,756 | A * | 1/1996 | Mahabadi et al. | 430/109.1 |
| 5,500,324 | A * | 3/1996 | Mahabadi et al. | 430/137.15 |
| 5,556,732 | A * | 9/1996 | Chow | 430/137.1 |
| 5,612,777 | A * | 3/1997 | Malhotra | 399/226 |
| 5,666,592 | A | 9/1997 | Aslam et al. | |
| 5,709,973 | A | 1/1998 | Chen et al. | |
| 5,716,750 | A | 2/1998 | Tyagi et al. | |
| 5,751,432 | A | 5/1998 | Gwaltney | |
| 5,887,235 | A | 3/1999 | Wayman et al. | |
| 6,101,345 | A | 8/2000 | Van Goethem et al. | |
| 6,248,496 | B1 | 6/2001 | Galloway et al. | |
| 6,438,336 | B1 | 8/2002 | Bengtson | |
| 6,535,712 | B2 * | 3/2003 | Richards | 399/341 |
| 6,716,560 | B2 * | 4/2004 | Alexandrovich | 430/109.2 |
| 6,983,119 | B2 | 1/2006 | Nakayama | |
| 7,058,348 | B2 | 6/2006 | Aslam et al. | |
| 7,088,946 | B2 | 8/2006 | Behnke et al. | |
| 7,139,521 | B2 | 11/2006 | Ng et al. | |
| 7,236,734 | B2 * | 6/2007 | Ng et al. | 399/341 |
| 7,304,770 | B2 | 12/2007 | Wang et al. | |
| 7,395,021 | B2 | 7/2008 | Tamura et al. | |
| 7,817,943 | B2 | 10/2010 | Utsumi et al. | |
| 7,881,639 | B2 | 2/2011 | Lioy | |
| 8,092,970 | B2 * | 1/2012 | Tyagi et al. | 430/124.1 |
| 2007/0098448 | A1 | 5/2007 | Hart et al. | |
| 2008/0118256 | A1 | 5/2008 | Playfair | |
| 2009/0325097 | A1 * | 12/2009 | Kurihara | 430/107.1 |
| 2010/0239324 | A1 * | 9/2010 | Winters et al. | 399/259 |
| 2011/0207044 | A1 * | 8/2011 | Zwartz et al. | 430/105 |
| 2012/0251146 | A1 * | 10/2012 | Tombs et al. | 399/55 |

* cited by examiner

*Primary Examiner* — G. M. Hyder
(74) *Attorney, Agent, or Firm* — Fay Sharpe LLP

(57) ABSTRACT

A color image forming machine is provided having a plurality of xerographic marking engines, each forming associated color separations that are combined to produce a color print image. Each marking engine includes a dual replenisher assembly having first and second reservoirs containing respective toners of different gloss levels. The reservoirs each include one or more augers separately and independently controlled for dispensing the respective toners into a developer to continuously vary the gloss level of the toner in the developer.

18 Claims, 5 Drawing Sheets

DUAL TONER REPLENISHER ASSEMBLY FOR CONTINUOUSLY VARIABLE GLOSS

BACKGROUND

Disclosed in embodiment herein are methods and apparatuses relating to an image forming machine, and more particularly, to a xerographic image forming machine having one or more marking engines with developers having dual replenisher assemblies providing a higher gloss and a lower gloss toner for achieving variable gloss.

A typical electrophotographic, or xerographic, printing machine employs a photoreceptor, that is charged to a substantially uniform potential so as to sensitize the surface thereof. The charged portion of the photoreceptor is exposed to a light image of an original document being reproduced. Exposure of the charged photoreceptor selectively dissipates the charge thereon in the irradiated areas to record an electrostatic latent image on the photoreceptor corresponding to the image contained within the original document. After the electrostatic latent image is recorded on the photoreceptor, the latent image is developed by bringing a developer material into contact therewith. Generally, the electrostatic latent image is developed with dry developer material, referred to as toner, comprising toner particles which are attracted to the latent image, forming a visible powder image on the photoconductive surface. After the electrostatic latent image is developed with the toner particles, the toner powder image is transferred to a sheet, such as paper or other substrate sheets, using pressure and heat to fuse the toner image to the sheet to form a print.

Toner has several fused characteristics which determine qualities of the resulting image print. The color a toner produces in a print is one characteristic. Another is the gloss level of the fused toner in the print, also referred to as gloss. Toners typically produce a fairly consistent gloss level, with high gloss toners being used to produce glossy prints and low gloss toners being used to produce low gloss, or matte prints.

It can be desirable to manipulate the gloss of printed images. However, a single toner has a fixed range of gloss that depends on fusing parameters such as the fuser roll temperature, substrate and age of the fuser. Thus the user has little latitude to change the gloss of the toner on any particular substrate. Also, gloss can vary with time as the fuser ages. Current options for changing gloss can include changing the fuser temperature/dwell by changing the fuser setpoint and/or print speed. This allows some latitude to change gloss, but can affect productivity (if the speed is lowered), or fuser life (if temperature is increased) or image permanence (if speed is increased or fuser roll temperature is decreased). Another option can include changing out the developer housing and the replenisher bottle with a toner of a different gloss. Yet another option can include adding an additional developer housing, such as for example, a $5^{th}$ housing in CMYK printing, and apply an overcoat with a different gloss than that used to image the toner.

It is desirable, therefore, to improve a xerographic image forming machine to provide variable control over the range of gloss levels available in the printed color image.

BRIEF DESCRIPTION

A color image forming machine is provided having a dual replenisher assembly including a first reservoir containing a relatively lower gloss toner and an auger moving the first toner out of the first reservoir in a controlled manner, a second reservoir containing a relatively higher gloss toner and a second auger moving the second toner out of the second reservoir in a controlled manner, a developer having a housing receiving the toners for application to the associated photoreceptor, and a controller controlling rotations of the first auger and the second auger independently thereby controlling relative amounts of the first toner and the second toner dispensed to the developer.

In one example, the reservoirs are individually removable replenisher vessels.

In another example, the reservoirs are part of an intermediate dispensing assembly disposed between first and second independently removable replenisher vessels and the developer.

A method of forming a color print in a xerographic image forming machine, is also provided including a controller controlling dispensing of first toner from a first reservoir and second toner from a second reservoir into a developer, the first toner having a first fused gloss level and the second toner having a second fused gloss level higher than the first fused gloss level, thereby providing variable control of the gloss level of the toner in the developer, developing a toner image on a photoreceptor using the toner in the developer, and fusing the toner image on a substrate forming a color image print.

DETAILED DESCRIPTION

Figure 1:
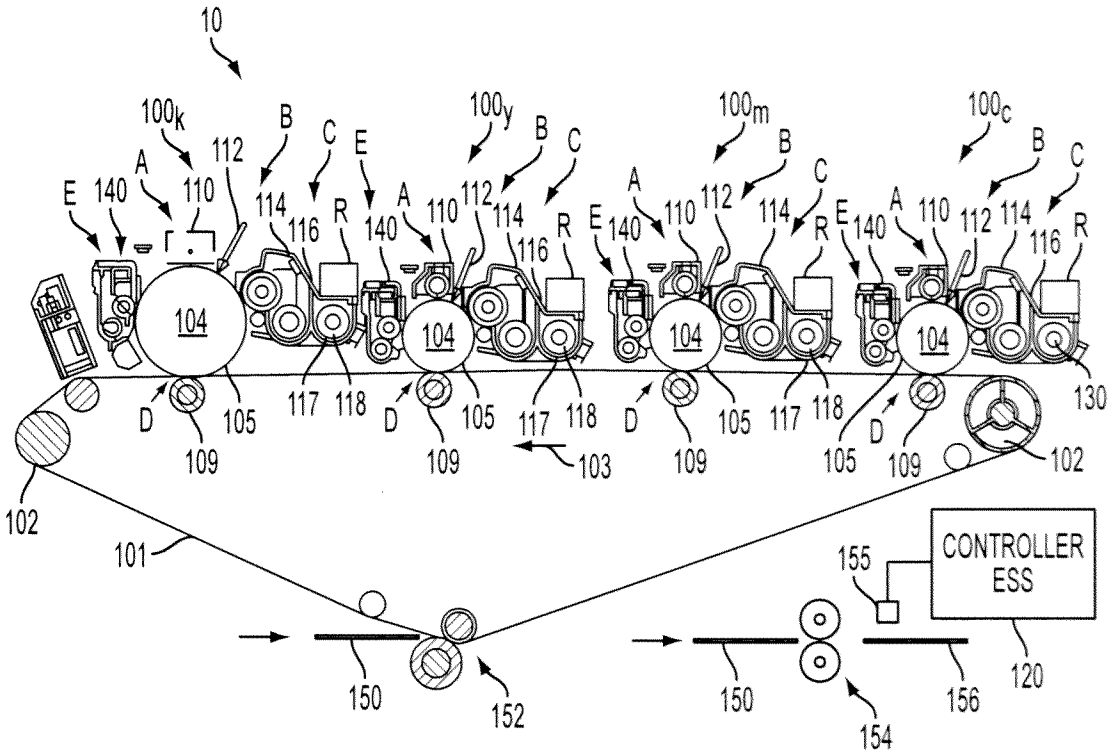
FIG. 1 illustrates a color image forming machine according to an exemplary embodiment of this disclosure.

As illustrated in FIG. 1, an image forming machine having the features described herein is shown generally at 10. The image forming machine 10, can be a xerographic or electrophotographic image forming device such as a multi-color digital printer, a digital color copy system, or the like. It includes a plurality of marking engines, referred to generally at 100, forming associated color separations that are combined to form a color print image, as described in further detail below.

The image forming machine shown by way of example is of a tandem architecture system including an intermediate transfer belt 101 entrained about a plurality of rollers 102 and adapted for movement in a process direction illustrated by arrow 103. Belt 101 is adapted to have transferred thereon a plurality of toner images, which are formed by the marking engines referred to generally at 100.

Each marking engine 100 forms an associated color separation by developing a single colorant toner image in succession on the belt 101 so that the combination of the color separations forms a multi-color composite toner image. While the color separations may be combined in different ways, they are each separately developed onto associated photoreceptors and then transferred to a compliant single-pass intermediate belt 101. When all of the desired color separations have been built up on the intermediate belt 101, the entire image is transfixed to substrate, such as paper, to form a print image.

One or more of the marking engines 100 includes a dual replenisher assembly R providing an associated developer with two toners of the same color, but with different fused gloss characteristics, such that one of the toners will produce a print with a comparatively lower gloss and the other toner will produce a print with a comparatively higher gloss.

For the purposes of example, which should not be considered limiting, the image forming machine 10 described herein is a CMYK marking system having four marking engines 100 which include: a cyan engine $\mathbf{100}_C$ forming a cyan color separation; a magenta engine $\mathbf{100}_M$ forming a magenta color separation; a yellow engine $\mathbf{100}_Y$ forming a yellow color separation; and a black engine $\mathbf{100}_K$ forming a black separation. However, it should be appreciated that a larger or smaller number of marking engines 100 can be used. For example, a larger number of marking engines 100 can be used for generating Extended colorant set images which typically include these four process-color colorant separations (CMYK) plus one or more additional color separations such as green, orange, violet, red, blue, white, varnish, light cyan, light magenta, gray, dark yellow, metallics, and so forth.

In other examples, the image forming machine can be an n-color imaging system (with n≥3) having n+1 marking engines 100, where the n+1 marking engine $\mathbf{100}_{OC}$ uses clear toners for form an overcoat layer on top of the other toners in the printed image. In one non-limiting example, an image forming machine 10' includes marking engines $\mathbf{100}_{OC}$, $\mathbf{100}_C$, $\mathbf{100}_M$, $\mathbf{100}_Y$ and $\mathbf{100}_K$ consecutively coupled to the intermediate transfer belt 101, as shown in FIG. 2.

Figure 2:
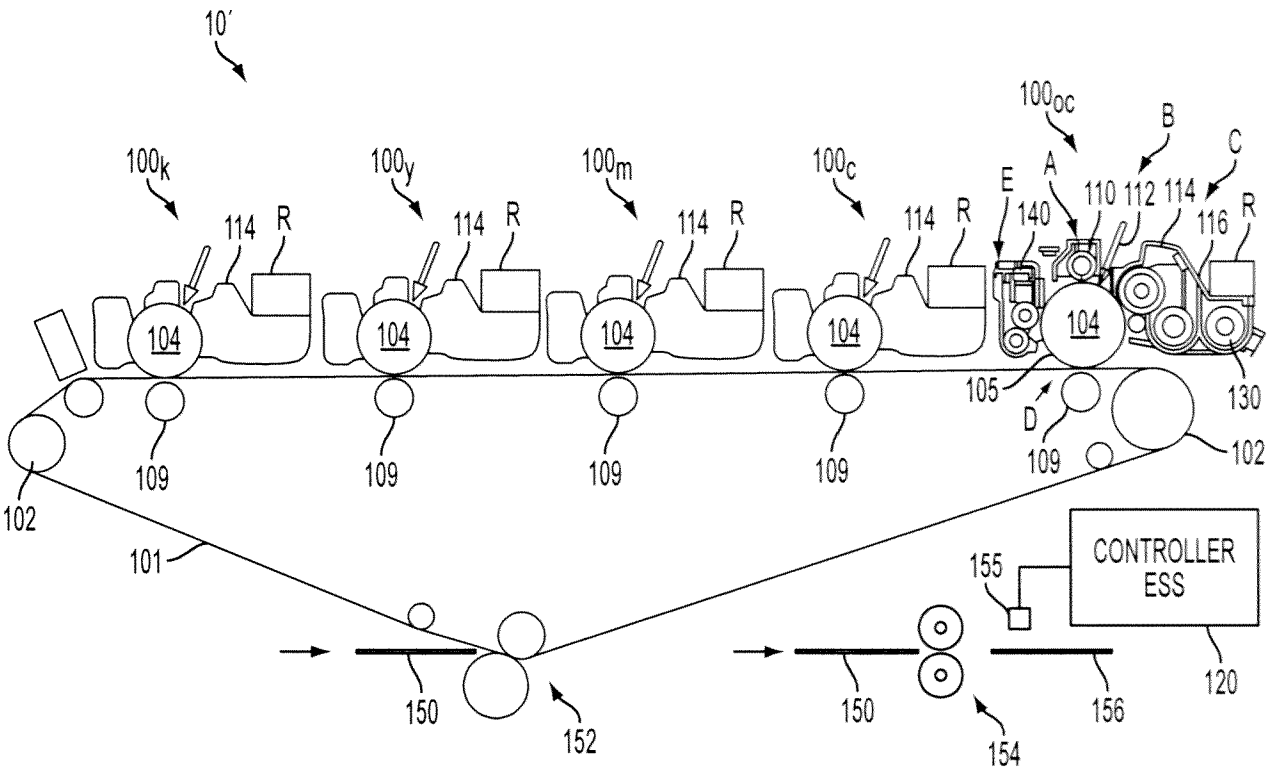
FIG. 2 illustrates a second example of a color image forming machine according to an exemplary embodiment of this disclosure.
Figure 3:
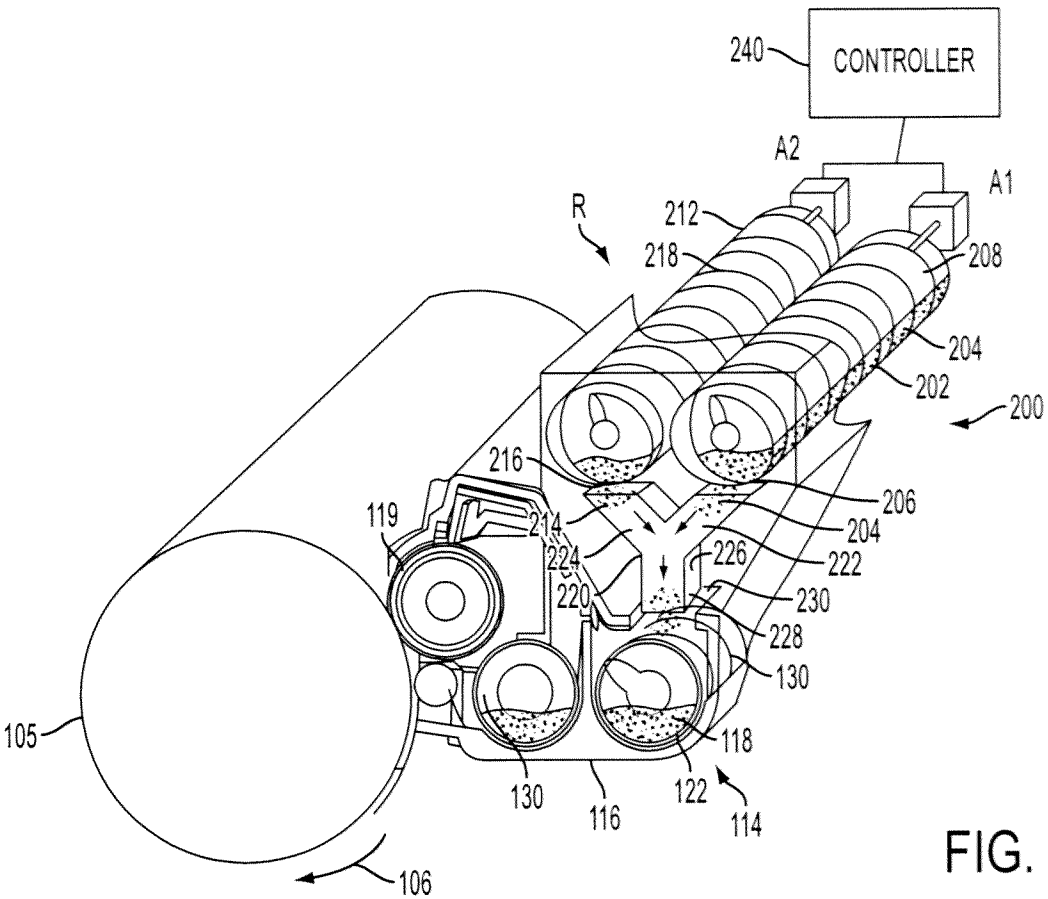
FIG. 3 illustrates a developer having a dual replenisher assembly for use in the color image forming machines of FIGS. 1 and 2.

Referring now to FIGS. 1-3, each marking engine $\mathbf{100}_C$, $\mathbf{100}_M$, $\mathbf{100}_Y$, $\mathbf{100}_K$ and $\mathbf{100}_{OC}$ includes a charge retentive member in the form of a drum-shaped photoreceptor 104, having a continuous, radially outer charge retentive surface 105 constructed in accordance with well known manufacturing techniques. The photoreceptor 104 is supported for rotation such that its surface 105 moves in a process direction shown at 106 past a plurality of xerographic processing stations (A-E) in sequence.

Initially, successive portions of the photoreceptor surface 105 pass through a first charging station A. At charging station A, a corona discharge device indicated generally at 110, charges portions of the photoreceptor surface 105 to a relatively high, substantially uniform potential during a charging operation.

Next, the charged portions of the photoreceptor surface 105 are advanced through a first exposure station B. At exposure station B, the uniformly charged photoreceptor charge retentive surface 105 is exposed to a scanning device 112 that causes the charge retentive surface to be discharged forming a latent image of the color separation of the corresponding engine. The scanning device 112 can be a Raster Output Scanner (ROS), non-limiting examples of which can include a Vertical Cavity Surface Emitting Laser (VCSEL), an LED image bar, or other known scanning device. The ROS 112 is controlled by a controller 120 to discharge the charge retentive surface in accordance with the digital color image data to form the latent image of the color separation. A non-limiting example of the controller 120 can include an Electronic Subsystem (ESS) shown in FIG. 1, or one or more other physical control devices. The controller 120 may also control the synchronization of the belt movement with the engines $\mathbf{100}_C$, $\mathbf{100}_M$, $\mathbf{100}_Y$, $\mathbf{100}_K$ and $\mathbf{100}_{OC}$ so that toner images are accurately registered with respect to previously transferred images during transfer from the latter to the former.

The marking engines $\mathbf{100}_C$, $\mathbf{100}_M$, $\mathbf{100}_Y$, $\mathbf{100}_K$ and $\mathbf{100}_{OC}$ also include a development station C, also referred to as a developer 114. The developer 114 includes a housing 116 holding toner 118 in a sump 122. The developer 114 includes one or more augers 130 for moving the toner 118 into contact with a magnetic brush, roller, or other toner applicator, indicated generally at 119 (shown in FIG. 3), advancing the toner 118 into contact with the electrostatic latent images on the photoreceptor 104 to form the toner image for the associated color separation as controlled by controller 120. The toner 118 not applied to the photoreceptor 104 is moved to a waste receptacle (not shown) for removal.

A dual replenisher assembly R is associated with each developer housing 116 which supplies a relatively higher gloss toner and a relatively lower gloss toner to the developer 114. The combination of the two toners in the developer 114 provides the developer with the toner 118 that is used during development of the image. This combination can range from 100% of the first toner and 0% of the second toner to 0% of the first toner and 100% of the second toner, or any desirable combination or ratio therebetween. The dual replenisher assembly R provides independent control of the feed rate of each toner dispensed to the developer 114 giving variable control of their ratio forming the developer toner 118, thereby providing variable gloss between that of the lower and higher gloss toner in the resulting print 156. In this way the gloss of each color separation in a color print can be varied separately, as described in further detail below.

At a transfer station D, an electrically biased roll 109 contacting the backside of the intermediate belt 101 serves to effect combined electrostatic and pressure transfer of toner images from the photoreceptor of the marking engine to the transfer belt. The roll 109 is biased to a suitable magnitude and polarity so as to electrostatically attract the toner particles from the photoreceptor 104 to the transfer belt 101 to form the toner image of the associated color separation on the transfer belt.

After the toner images are transferred from the photoreceptor 104, the residual toner particles carried by the non-image areas on the photoreceptor surface are removed from it at cleaning station E. A cleaning housing 140 supports therewithin cleaning brushes which remove the toner from the photoreceptor surface 105.

After all of the toner images have been transferred from the engines $\mathbf{100}_C$, $\mathbf{100}_M$, $\mathbf{100}_Y$, $\mathbf{100}_K$ and $\mathbf{100}_{OC}$ the multi-color composite toner image is transferred to a substrate 150, such as plain paper, by passing through a conventional transfer device 152. The substrate 150 may then be directed to a fuser device 154 to fix the multi-color composite toner image to the substrate to form the color print 156.

Referring now to FIG. 3, one example of the dual replenisher assembly R is shown generally at 200. The replenisher assembly 200 includes a first replenisher reservoir 202 containing a first toner 204 having first fused gloss characteristics of a relatively higher gloss. The first replenisher reservoir 202 includes an exit opening 206 through which the first toner 204 can be supplied to the developer 114. An auger 208 is disposed within the first replenisher reservoir 202. An actuator A1, such as for example a motor, is coupled to the first auger 208 for rotating the auger to move the first toner 204 in a controlled manner to the exit opening 206 thereby supplying a controlled amount of the first toner to the developer 114.

The replenisher assembly 200 also includes a second replenisher reservoir 212 containing a second toner 214 having second fused gloss characteristics of a relatively lower gloss, lower than the first toner 204. The second replenisher reservoir 212 includes an exit opening 216 through which the second toner 214 can be supplied to the developer 114. An auger 218 is disposed within the second replenisher reservoir 212. An actuator A2, such as for example a motor, is coupled to the second auger 218 for rotating the auger to move the second toner 214 in a controlled manner to the exit opening 216 thereby supplying a controlled amount of the second toner to the developer 114.

The replenisher reservoirs 202, 212 can be removable vessels, such as replenisher bottles or the like, which can be individually removed from the dual replenisher assembly 200 for refilling the respective toners 204, 214, or different toners, if so desired. Alternatively, the individually removable vessels 202, 212 can replaced to add or change the toners being used.

In one non-limiting example, a toner chute 220 is disposed between the replenisher reservoirs 202, 212 and the developer housing 116 for conveying the first toner 204 and second toner 214 from the respective exit ports 206, 216 and into the developer housing 116. The toner chute 220 includes a first passage 222 disposed beneath the exit opening 206 of the first replenisher reservoir 202 receiving the first toner 204, and a second passage 224 disposed beneath the exit opening 216 of the second replenisher reservoir 212 receiving the second toner 214. The first and second passages connect with a third passage 226 having an exit opening 228 disposed above an entry opening 230 in the developer housing 116.

A controller 240 is connected to the actuators A1 and A2 providing independent control of the associated first and second augers 208, 218. The controller 240 controls the run time of the first actuator A1 turning the first auger 204 to dispense a controlled amount of first toner into developer housing. The controller 240 can also control the speed of the first actuator A1, thereby controlling the speed of the first auger 208 to dispense a controlled amount of first toner into developer housing 116. The controller 240 also controls the run time of the second actuator A2 turning the second auger 214 to dispense a controlled amount of second toner into developer housing 116. The controller 240 can also control the speed of the second actuator A2, thereby controlling the speed of the second auger 218 to control the amount of second toner 214 dispensed into developer sump 122.

Figure 4:
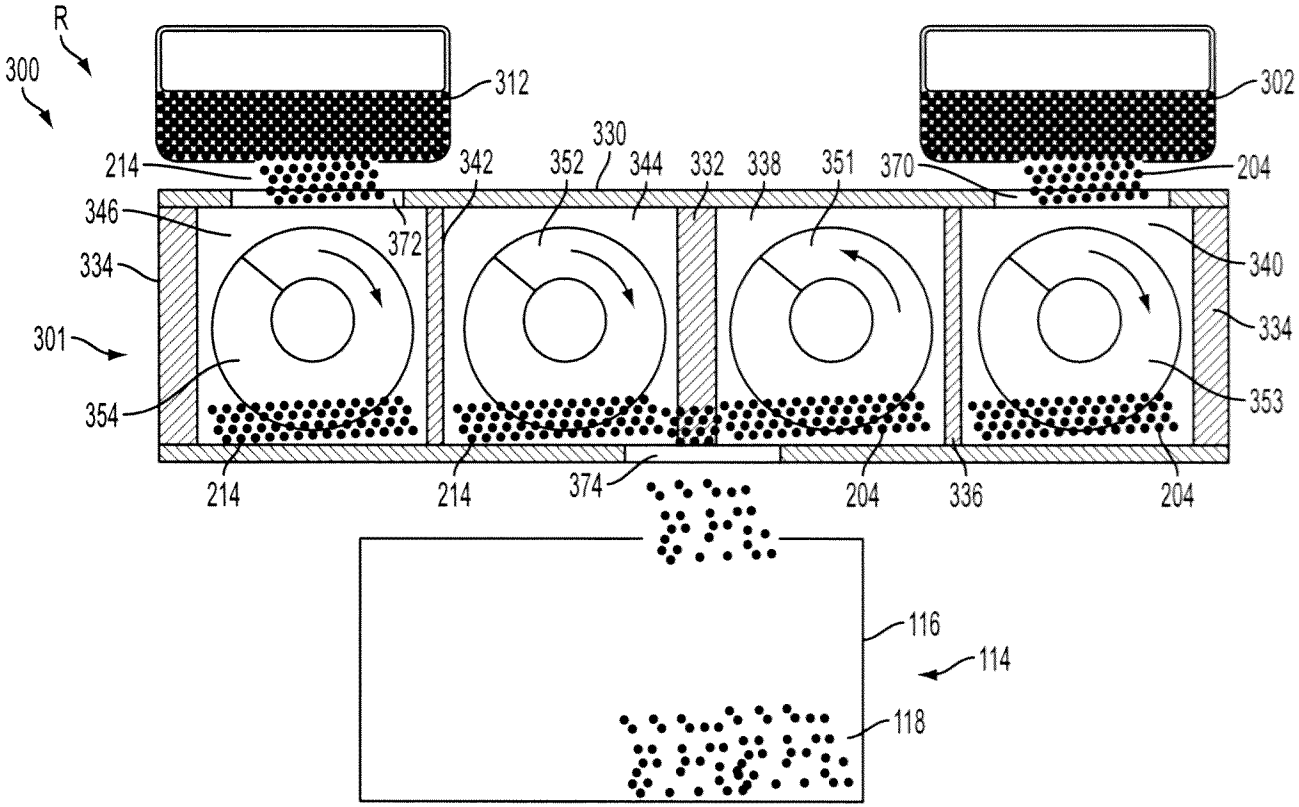
FIG. 4 illustrates second example of a developer having a dual replenisher assembly for use in the color image forming machines of FIGS. 1 and 2 showing a cross section of FIG. 5.
Figure 5:
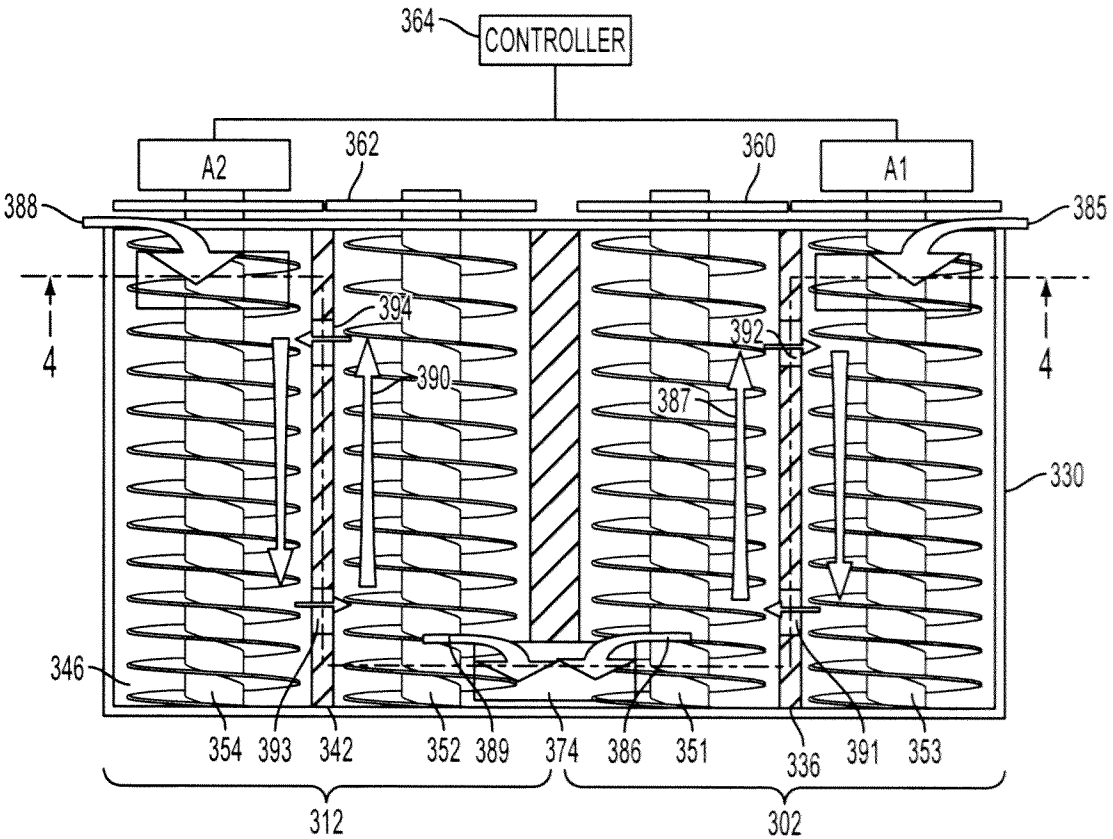
FIG. 5 illustrates a top view, with portions of the top removed for clarity, of the second example of the dual replenisher assembly for use in the color image forming machines of FIGS. 1 and 2.

Referring to FIGS. 4 and 5, a second embodiment of the dual replenisher assembly R is shown generally at 300. The dual replenisher assembly 300 includes an intermediate dispensing assembly 301 disposed between removable replenisher vessels and the developer 114. The replenisher vessels include a first replenisher vessel 302 containing the first toner 204 and a second replenisher vessel 312 containing the second toner 214.

The replenisher vessels 302, 312, also known as replenisher bottles, can be removable, individually, from the dual replenisher assembly 300 for refilling with the respective toners 204, 214, or different toners, if so desired. Alternatively, the individually removable vessels can replaced to add or change the toners being used.

The intermediate dispensing assembly 301 includes a housing 330 having a central wall 332 disposed between end walls 334. The central wall 332 separates a first reservoir 302 and a second reservoir 312 disposed within the housing 330, as shown in FIG. 4. The first reservoir 302 includes a dividing wall 336 disposed between the central wall 332 and one end wall 334 that separates a first chamber 338 and a second chamber 340 of the first reservoir. The second reservoir 312 includes a dividing wall 342 disposed between the central wall 332 and the other end wall 334 that separates a first chamber 344 and a second chamber 346 of the second reservoir.

A first auger 351 is disposed in the first chamber 338 of the first reservoir 302. A second auger 352 is disposed in the first chamber 344 of the second reservoir 312. A third auger 353 is disposed in the second chamber 340 of the first reservoir 302. A fourth auger 354 is disposed in the second chamber 346 of the second reservoir 312.

The first and third augers 351, 353 of the first reservoir 302 are connected together, such as for example by gears 360, for mutual rotation in opposite directions by a first actuator A1. The second and fourth augers 352, 354 of the second reservoir 312 are connected together, such as for example by gears 362, for mutual rotation in opposite directions by a second actuator A2. The actuators A1 and A2 are independently controlled in a variable manner by controller 364 for independently dispensing a controlled amount of the first toner and second toner into the housing.

The first reservoir 302 of the intermediate dispensing assembly 301 includes an entrance opening 370 disposed in the top of the housing 330 providing communication between a first toner vessel 302, such as for example a replaceable toner bottle, and the second chamber 340 of the first reservoir. The second reservoir 312 of the intermediate dispensing assembly 301 includes an entrance opening 372 disposed in the top of the housing 330 providing communication between a second toner vessel 312, such as a replaceable toner bottle, and the second chamber 346 of the second reservoir. The first and second reservoirs 302, 312 share an exit opening 374 disposed in the bottom of the intermediate dispensing assembly housing 330 which communicates with the first chambers 338,344.

Referring to FIG. 5, the operation of the dual replenisher assembly 300 with dual reservoir intermediate dispensing assembly 301 is described in further detail. The first toner 204 flows from the first toner vessel 302 through the first reservoir entrance opening 370 and into the second chamber 340 of the first reservoir 302 as shown by arrow 385. The first actuator A1 rotates the third auger 353 in the second chamber 340 in a first rotational direction and the first auger 351 in the first chamber 338 in a second rotational direction, opposite the first direction, dispensing a controlled amount of toner out of the exit opening 374 of the first chamber 338 as shown by arrow 386. The first toner 204 is also moved in a circular direction shown by arrows 387 through first and second openings 391, 392 in the dividing wall 336 separating the first and second chambers 338, 340 allowing it to be re-circulated. Similarly, the second toner 214 flows from the second toner vessel 312 through the second reservoir entrance opening 372 and into the second chamber 346 of the second reservoir 312 as shown by arrow 388. The second actuator A2 rotates the fourth auger 354 in the second chamber 346 in a first rotational direction and the second auger 352 in the first chamber 344 in a second rotational direction, opposite the first direction dispensing a controlled amount of toner out of the exit opening 374 of the first chamber 344 of the second reservoir 312 as shown by arrow 389. The second toner 214 is also moved in a circular direction shown by arrows 390 through first and second openings 393, 394 in the dividing wall 342 separating the first and second chambers 344, 346 of the second reservoir 312 allowing it to be re-circulated. As mentioned, the first and third augers 351, 353 are controlled independently of the second and fourth augers 352, 354 thereby providing independent control of the amount of each toner 204, 214 dispensed into the developer housing 116. The amount of each toner 204, 214 that is dispensed is determined by the speed of rotation and the length of time the augers 351-354 are rotated by the respective actuators A1, A2. The reservoirs 302, 312 can be made with a relatively small volume, which soon fill with the respective toners 204, 214. This configuration provides precise control of respective amount of each toner dispensed into the developer 114.

The two replenisher vessels 202, 212, 302, 312 can be made smaller than conventional replenisher vessels to fit into current image processing machines 10, 10' without requiring more space, if so desired. If printing, on average, was near the mid-point gloss of the two toners 204, 214 this would have no effect on how often replenisher vessels would have to be changed. For long runs of low gloss or high gloss one replenisher vessel would need to be changed more often, however, there would be no effect either way on print yield per kg of toner used.

A method for producing images with variable controlled gloss is hereby provided which includes an imaging system having two replenisher reservoirs 202, 302, 212, 312 supplying one developer housing 116, where one of the replenishers has a higher gloss toner than the other, and where the feed rate of both replenishers is separately variable, as described above.

The controller 120, 240, 364 can actuate the first actuator A1 to control the amount of the first toner 204 dispensed from the first reservoir 202, 302, into the developer 114, as described above. The controller 120, 240, 364 can actuate the second actuator A2, to control the amount of the second toner 214 dispensed from the second reservoir 212, 312, into the developer 114, as described above. The actuators A1 and A2 are independently controlled to simultaneously dispense varying amounts of the high gloss and low gloss toner into the developer. Further, either actuator A1 or A2 can be controlled to dispense only one of the toners 204 or 214 into the developer. In this manner, the toner 118 in the developer can be varied from 100% of the first toner 204 and 0% of the second toner 214, to 0% of the first toner and 100% of the second toner, thereby providing a toner having a gloss level that is variable between the gloss level of the lower gloss toner and the gloss level of the higher gloss toner. The developer 114 develops the toner image on the photoreceptor using the toner 118 and the toner image is subsequently fused on the substrate to form a color image print, as described above.

In one example, consider two toners with two different gloss levels that are prepared with peak gloss of 80 ggu and peak gloss of 10 ggu respectively, and having the printer 10, 10' running at nominal 8% toner concentration (TC) with a gloss of 20 ggu. In one example printer, there is typically about 35 grams of toner in the sump 122. Initially the dispense could be run adding 4% TC of 80 ggu gloss toner to the sump 122, bringing the TC to 12%, within the TC latitude limits of the printer. If gloss is approximately linear with the mixing of the two toners, then gloss would increase during this admix time from 20 to about 60 ggu. During this admix time of the additional 4% TC of toner, the printer could be left on, in which case some prints of transitional gloss would be made.

In another example, the printer 10, 10' can enter a "change gloss" cycle where the developer housing 116 mixes but no prints are made. The one or more developer augers 130 can be actuated to move the toner 118 from the developer sump 122 into a waste receptacle while controlling the dispensing of the toners in order to change the relative amounts of the first and second toner in the developer 114. Depending on the magnitude of the gloss change and thus TC change required, this could be done over a period of time from about 1 to 5 minutes, by way of example which should not be considered limiting. After this, printing could then begin at the new gloss level of 60 ggu. As the toner in the sump 122 is replaced, the TC can be allowed to fall and the ratio of the two gloss toners 204, 214 fed into the developer housing 116 would change to maintain the new gloss level. In this way, the gloss of the toner 118 in the developer 114 can be changed to a gloss from 20 to 60 ggu, without changing out the replaceable replenisher vessels. Smaller changes in gloss would require little hold time.

In one example, the gloss of each color toner 118 used by a respective marking engine 100 for each color separation can be varied separately to allow special effects, where one or more toner colors are highlighted by high gloss, while the other colors are matte. In another example, the same gloss level can be achieved for each color on the print.

In another example, one of the developer housings 116 in the multicolor imaging machine 10' can be fed with two replenisher reservoirs 202, 302, 212, 312 having clear toners including a clear toner 202 having a relatively higher gloss level and a clear toner 214 having a relatively lower gloss, whose feed rate can be changed as described above to vary the gloss of an overcoat layer, to control the final gloss of the image.

As shown in FIG. 1, an optional in-line gloss meter 155 disposed after the fuser 154 can be used for real-time measurement of the gloss level of the print and to provide this measurement as feedback to the controller 120, 240, or 364 to control the gloss of the print 156.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A color image forming machine generating associated color separations in a color toner image on an associated photoreceptor for producing a color print comprising:

a dual replenisher assembly including:

an individually removable first replenisher vessel forming a first reservoir for containing a first toner having a first fused gloss level, the first reservoir having an exit opening an individually removable second replenisher vessel forming a second reservoir for containing a second toner having a second fused gloss level of a higher gloss than the first toner, the second reservoir having an exit opening, a first auger disposed in the first reservoir for moving the first toner out of the first reservoir exit opening in a controlled manner, and a second auger disposed in the second reservoir for moving the second toner out of the second reservoir exit opening in a controlled manner, and a developer disposed adjacent an associated photoreceptor, the developer having a housing receiving the first toner and the second toner for application to the associated photoreceptor; and a controller for controlling rotations of the first auger and the second auger independently thereby controlling relative amounts of the first toner and the second toner dispensed to the developer.

2. The color image forming machine of claim 1, further comprising:

a first actuator connected to the first auger and controlled by the controller for rotating the first auger; and a second actuator connected to the second auger and controlled by the controller for rotating the second auger.

3. The color image forming machine of claim 1, further comprising an inline gloss meter connected to the controller providing feedback of gloss levels of prints formed by the image forming machine for controlling relative amounts of the first toner and the second toner dispensed to the developer.

4. The color image forming machine of claim 1, further comprising:

a plurality of developers; and a plurality of dual replenisher assemblies each associated with a different one of the plurality of developers, wherein the controller controls rotations of the first auger and the second auger of each dual replenisher assembly independently thereby controlling relative amounts of the first toner and the second toner of each dual replenisher assembly dispensed to each associated developer.

5. A color image forming machine generating associated color separations in a color toner image on an associated photoreceptor for producing a color print comprising:

a dual replenisher assembly including:

a first removable replenisher vessel containing a first toner having a first fused gloss level, a second removable replenisher vessel containing a second toner having a second fused gloss level of a higher gloss than the first toner, an intermediate dispensing assembly including:

a housing disposed between the first and second replenisher vessels and the developer, the housing having a first reservoir for containing the first toner, the first reservoir having an exit opening, a second reservoir for containing the second toner, the second reservoir having an exit opening, and a central wall separating the first reservoir and the second reservoir, a first auger disposed in the first reservoir adapted to move the first toner out of the first reservoir exit opening in a controlled manner, and a second auger disposed in the second reservoir for moving the second toner out of the second reservoir exit opening in a controlled manner;

a developer disposed adjacent an associated photoreceptor, the developer having a housing receiving the first toner and the second toner for application to the associated photoreceptor, wherein the intermediate dispensing assembly is disposed between the first and second replenisher vessels and the developer; and a controller controlling rotations of the first auger and the second auger independently thereby controlling relative amounts of the first toner and the second toner dispensed to the developer.

6. The color image forming machine of claim 5 further comprising:

the first reservoir having a dividing wall separating a first chamber containing the first auger and a second chamber containing a third auger connected to the first auger for mutual rotation in opposite directions, the dividing wall having first and second openings communicating between the first and second chambers of the first reservoir, the housing having an first reservoir entrance opening communicating with the second chamber;

the second reservoir having a dividing wall separating a first chamber containing the first auger and a second chamber containing a fourth auger connected to the second auger for mutual rotation in opposite directions, the first dividing wall having first and second openings communicating between the first and second chambers of the second reservoir, the housing having an second reservoir entrance opening communicating with the second chamber of the second reservoir;

a first actuator connected to the first and third augers and controlled by the controller rotating the first and third augers and moving the first toner from the entrance opening to the first reservoir exit opening for dispensing the first toner to the developer; and a second actuator connected to the second and fourth augers and controlled by the controller rotating the second and fourth augers and moving the second toner from the entrance opening to the second reservoir exit opening for dispensing the second toner to the developer.

7. The color image forming machine of claim 5, further comprising an inline gloss meter connected to the controller providing feedback of gloss levels of prints formed by the image forming machine for controlling relative amounts of the first toner and the second toner dispensed to the developer.

8. The color image forming machine of claim 5, further comprising:

a plurality of developers; and a plurality of dual replenisher assemblies each associated with a different one of the plurality of developers, wherein the controller controls rotations of the first auger and the second auger of each dual replenisher assembly independently thereby controlling relative amounts of the first toner and the second toner of each dual replenisher assembly dispensed to each associated developer.

9. A dual replenisher assembly for an image forming machine having a developer comprising:

an individually removable first replenisher vessel forming a first reservoir containing a first toner having first fused gloss characteristics, the first reservoir having an exit opening; and an individually removable second replenisher vessel forming a second reservoir containing a second toner having second fused gloss characteristics having a higher gloss than the first toner, the second reservoir having an exit opening;

a first auger disposed in the first reservoir for moving the first toner out of the first reservoir exit opening and into an associated developer in a controlled manner; and a second auger disposed in the second reservoir for moving the second toner out of the second reservoir exit opening and into an associated developer in a controlled manner.

10. The dual replenisher assembly of claim 9, further comprising a chute disposed between the exit openings and the associated developer transferring the first toner and the second toner to the associated developer.

11. The dual replenisher assembly of claim 9, further comprising:

a first actuator connected to the first auger rotating the first auger in a controlled manner; and a second actuator connected to the second auger rotating the second auger in a controlled manner.

12. A dual replenisher assembly for an image forming machine having a developer comprising:

a first removable replenisher vessel containing a first toner having a first fused gloss level;

a second removable replenisher vessel containing a second toner having a second fused gloss level of a higher gloss than the first toner; and an intermediate dispensing assembly including:

a housing disposed between the first and second replenisher vessels and the developer, the housing having a first reservoir for containing the first toner, the first reservoir having an exit opening, a second reservoir for containing the second toner, the second reservoir having an exit opening, and a central wall separating the first reservoir and the second reservoir, a first auger disposed in the first reservoir adapted to move the first toner out of the first reservoir exit opening in a controlled manner, and a second auger disposed in the second reservoir for moving the second toner out of the second reservoir exit opening in a controlled manner.

13. The dual replenisher assembly of claim 12 further comprising:

the first reservoir having a dividing wall separating a first chamber containing the first auger and a second chamber containing a third auger connected to the first auger for mutual rotation in opposite directions, the dividing wall having first and second openings communicating between the first and second chambers of the first reservoir, the housing having an first reservoir entrance opening communicating with the second chamber;

the second reservoir having a dividing wall separating a first chamber containing the first auger and a second chamber containing a fourth auger connected to the second auger for mutual rotation in opposite directions, the first dividing wall having first and second openings communicating between the first and second chambers of the second reservoir, the housing having an second reservoir entrance opening communicating with the second chamber of the second reservoir;

a first actuator connected to the first and third augers and controlled by the controller rotating the first and third augers and moving the first toner from the entrance opening to the first reservoir exit opening for dispensing the first toner to the developer; and a second actuator connected to the second and fourth augers and controlled by the controller rotating the second and fourth augers and moving the second toner from the entrance opening to the second reservoir exit opening for dispensing the second toner to the developer.

14. A method of forming a color print in a xerographic image forming machine comprising:

controlling dispensing of first toner from a first reservoir and second toner from a second reservoir into a developer by controlling rotations of first and third augers in the first reservoir independently of second and fourth augers in the second reservoir, the first toner having a first fused gloss level and the second toner having a second fused gloss level higher than the first fused gloss level providing variable control of the gloss level of the toner in the developer;

developing a toner image on a photoreceptor using the toner in the developer; and fusing the toner image on a substrate forming a color image print.

15. The method of claim 14 further comprising:

controlling dispensing of first toners from first reservoirs and second toners from second reservoirs into corresponding developers for a plurality of different color separations by controlling rotations of first and third augers in the first reservoirs independently of second and fourth augers in the second reservoirs providing variable control of the gloss levels of the toners in the developers for each of the different color separations;

developing toner images on photoreceptors using the toners in the developers; and fusing the toner images on a substrate forming a color image print.

16. The method of claim 15 wherein the first toners and the second toners include cyan, magenta, yellow and black toners.

17. The method of claim 15 wherein the first toners and the second toners include three or more of cyan, magenta, yellow, orange, green, red, blue, violet, purple, black, white and metallic toners.

18. The method of claim 17 wherein one of the first toners and the second toners are clear toners forming a clear overcoat in the fusing the toner images on the substrate.

* * * * *